US009053882B2

(12) United States Patent
Reuber

(10) Patent No.: US 9,053,882 B2
(45) Date of Patent: Jun. 9, 2015

(54) MAGNETIC ACTUATOR UNIT FOR A CIRCUIT-BREAKER ARRANGEMENT

(75) Inventor: Christian Reuber, Willich (DE)

(73) Assignee: ABB TECHNOLOGY AG, Zurich (CH)

( * ) Notice: Subject to any disclaimer, the term of this patent is extended or adjusted under 35 U.S.C. 154(b) by 0 days.

(21) Appl. No.: 13/487,412

(22) Filed: Jun. 4, 2012

(65) Prior Publication Data

US 2012/0268223 A1 Oct. 25, 2012

Related U.S. Application Data

(63) Continuation of application No. PCT/EP2010/007357, filed on Dec. 3, 2010.

(30) Foreign Application Priority Data

Dec. 4, 2009 (EP) ..... 09015046

(51) Int. Cl.

| | |
|---|---|
| ***H01H 9/00*** | (2006.01) |
| ***H01H 33/38*** | (2006.01) |
| *H01H 3/28* | (2006.01) |
| *H01H 33/666* | (2006.01) |

(52) U.S. Cl.

CPC ..... *H01H 33/38* (2013.01); *H01H 3/28* (2013.01); *H01H 33/6662* (2013.01)

(58) Field of Classification Search

CPC ..... H01H 51/01; H01H 33/6662
USPC ..... 335/179, 126; 218/118
See application file for complete search history.

(56) References Cited

U.S. PATENT DOCUMENTS

| | | | | | |
|---|---|---|---|---|---|
| 2,912,543 | A | * | 11/1959 | Hawkins | 335/122 |
| 2,920,162 | A | * | 1/1960 | Steward et al. | 335/126 |
| 2,938,092 | A | * | 5/1960 | Steward | 335/126 |
| 2,999,192 | A | * | 9/1961 | Lambert | 335/236 |

(Continued)

FOREIGN PATENT DOCUMENTS

| | | | |
|---|---|---|---|
| GB | 1 454 354 | A | 11/1976 |
| WO | WO 2008/119785 | A1 | 10/2008 |

OTHER PUBLICATIONS

International Search Report (PCT/ISA/210) issued on Mar. 30, 2011, by the European Patent Office as the International Searching Authority for International Application No. PCT/EP2010/007357.

(Continued)

*Primary Examiner* — Alexander Talpalatski
(74) *Attorney, Agent, or Firm* — Buchanan Ingersoll & Rooney PC

(57) ABSTRACT

A magnetic actuator unit is disclosed for a circuit-breaker arrangement, having an armature arranged to be movable between first and second, closed and opened end switching positions of the circuit-breaker, a single electrical coil for moving the armature to the second position due to electrical current feed, a permanent magnet for loading the armature in the direction of the second position, an outer ferromagnetic yoke at least partly surrounding the single electrical coil and the ferromagnetic core for directing magnetic flux to the armature, and an opening spring for permanent loading of the armature in the direction of the first position, which is coaxially arranged between the armature and the front side of the electrical coil. The opening spring can be at least partly accommodated inside an armature groove.

15 Claims, 2 Drawing Sheets

(56) References Cited

U.S. PATENT DOCUMENTS

| | | | | | |
|---|---|---|---|---|---|
| 3,086,094 | A * | 4/1963 | Ovshinsky | 335/63 |
| 3,409,851 | A * | 11/1968 | Scheib, Jr. et al. | 335/126 |
| 3,444,490 | A * | 5/1969 | Bowles et al. | 335/126 |
| 3,693,122 | A * | 9/1972 | Willard | 335/174 |
| 3,783,423 | A * | 1/1974 | Mater et al. | 335/174 |
| 4,399,421 | A * | 8/1983 | MacLean | 335/174 |
| 4,633,209 | A * | 12/1986 | Belbel et al. | 335/261 |
| 4,641,117 | A * | 2/1987 | Willard | 335/7 |
| 4,660,012 | A * | 4/1987 | Bonniau et al. | 335/234 |
| 4,801,910 | A * | 1/1989 | Ayers et al. | 335/230 |
| 4,876,521 | A * | 10/1989 | Boyd | 335/179 |
| 5,734,309 | A * | 3/1998 | Schmitz | 335/177 |
| 6,424,244 | B1 * | 7/2002 | Hendel | 335/177 |
| 6,831,535 | B1 * | 12/2004 | Wen et al. | 335/132 |
| 7,156,057 | B2 * | 1/2007 | Lecrivain et al. | 123/90.11 |
| 2005/0274335 | A1 * | 12/2005 | Lecrivain et al. | 123/90.11 |
| 2008/0067152 | A1 * | 3/2008 | Kikukawa et al. | 218/139 |
| 2008/0238594 | A1 * | 10/2008 | Liu et al. | 335/229 |
| 2008/0308531 | A1 * | 12/2008 | Tsuchiya et al. | 218/118 |
| 2008/0308532 | A1 * | 12/2008 | Tsuchiya et al. | 218/118 |
| 2009/0032500 | A1 * | 2/2009 | Kobayashi et al. | 218/140 |
| 2009/0039989 | A1 * | 2/2009 | Reuber | 335/127 |
| 2009/0167470 | A1 * | 7/2009 | Cusicanqui et al. | 335/170 |
| 2010/0170874 | A1 * | 7/2010 | Tsuchiya et al. | 218/118 |
| 2011/0155697 | A1 * | 6/2011 | Lee | 218/140 |

OTHER PUBLICATIONS

Written Opinion (PCT/ISA/237) issued on Mar. 30, 2011, by the European Patent Office as the International Searching Authority for International Application No. PCT/EP2010/007357.

* cited by examiner

MAGNETIC ACTUATOR UNIT FOR A CIRCUIT-BREAKER ARRANGEMENT

RELATED APPLICATION

This application claims priority as a continuation application under 35 U.S.C. §120 to PCT/EP2010/007357, which was filed as an International Application on Dec. 3, 2010 designating the U.S., and which claims priority to European Application 09015046.7 filed in Europe on Dec. 4, 2009. The entire contents of these applications are hereby incorporated by reference in their entireties.

FIELD

A magnetic actuator unit for a circuit breaker arrangement is disclosed, such as an actuator unit which includes an armature arranged to be movable between a first and a second end position for an opened and a closed switching position respectively of a circuit-breaker, a single electrical coil for moving the armature to the second position due to electrical current feed, a permanent magnet for additionally loading the armature in the direction of the second position, an outer ferromagnetic yoke at least partly surrounding the single electrical coil and the ferromagnetic core for directing the magnetic flux to the movable ferromagnetic armature, and an opening spring for permanently loading the armature in the direction of the first position, which is coaxially arranged between the armature and the front side of the electrical coil.

For operation of a circuit-breaker, such as a medium-voltage vacuum circuit-breaker, a high force can be generated to press a moving electrical contact to a corresponding fixed electrical contact, This force can be generated by a magnetic actuator unit. Both electrical contacts can be integrated in a pole part for insulating purpose wherein the movable electrical contact is operated by the magnetic actuator unit via a jackshaft arrangement. The jackshaft arrangement can drive more than one pole part. For a 3-phase power grid circuit-breaker application the jackshaft arrangement drives three pole parts by a single magnetic actuator unit.

BACKGROUND INFORMATION

The document WO 2008/119785 A1 discloses a magnetic actuator unit for a circuit-breaker having a first electrical coil, a second electrical coil and an armature arranged to be moveable between the first and second end position by means of said electrical coils. The electrical coils are arranged in an anti-series connection, and both coils are energized simultaneously for effectuating the movement of the armature between the two end positions. This technical solution provides a bistable actuating arrangement and two electrical coils are necessary therefore.

The document GB 1,454,354 discloses another magnetic actuator unit with only one electrical coil for moving the armature to one of the end positions. Additionally, an integrated opening spring is provided to generate force in the opposite direction. The opening spring is arranged inside the magnetic actuator unit surrounding the armature, which is also accommodated mostly inside the magnetic actuator unit in order to keep the volume of the arrangement as small as possible. However, the arrangement of the specific parts, especially the yoke surrounding the whole magnetic actuator unit, is not able to generate a high actuating force. For operation of modern medium voltage-circuit-breakers a higher force is used to operate the moving electrical contact.

SUMMARY

A magnetic actuator unit is disclosed for a circuit-breaker arrangement, comprising: a disk-shaped ferromagnetic armature arranged to be movable between a first and second end position for an opened and closed switching position respectively of a circuit-breaker; a single electrical coil for moving the armature to the second end position in response to an electrical current feed; a permanent magnet for additionally loading the armature in a direction of a second position; an outer ferromagnetic yoke at least partly surrounding the single electrical coil and a ferromagnetic core for directing magnetic flux to the armature; and an opening spring means for loading the armature in a direction of the first position, which is coaxially arranged between said armature and a front side of the electrical coil, wherein the opening spring means are at least partly accommodated inside a groove formed in the armature whose dimension corresponds to an outer shape of the ferromagnetic yoke.

A medium voltage circuit-breaker is also disclosed comprising: at least one pole part with an integrated pair of corresponding electrical contacts, wherein one of the electrical contacts of each pole part is axially movable inside the pole part in order to form an electrical switch; and a jackshaft arrangement for operating the electrical switch by an armature of a magnetic actuator.

BRIEF DESCRIPTION OF THE DRAWINGS

The foregoing and other aspects of the invention will be apparent from and elucidated with reference to the exemplary embodiments described hereinafter. An exemplary embodiment will be described in more detail with reference to the attached drawings, wherein.

Figure 1:
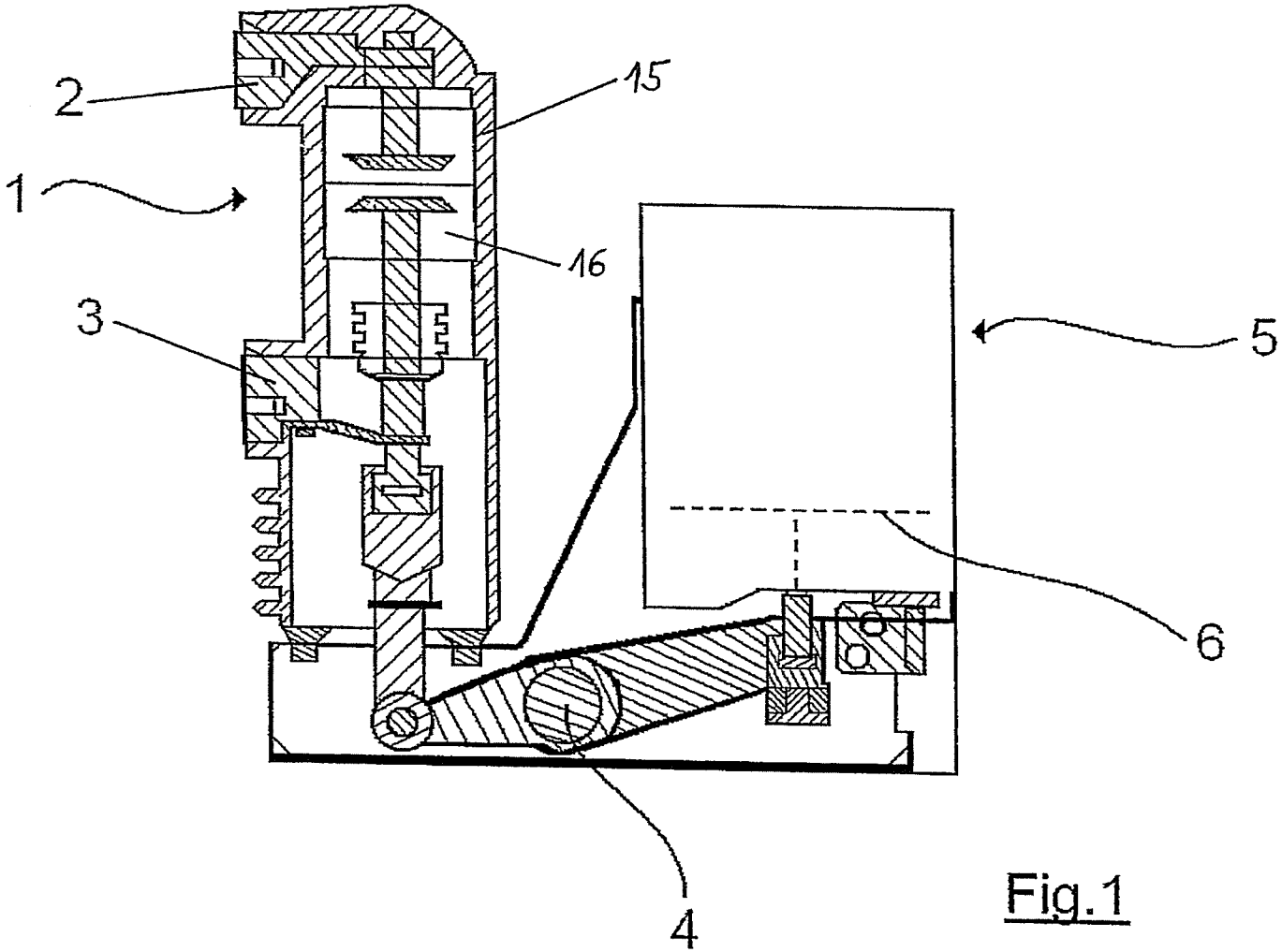
FIG. 1 shows an exemplary medium-voltage circuit-breaker arrangement with a magnetic actuator unit.

All drawings are schematic.

DETAILED DESCRIPTION

A magnetic actuator unit is disclosed for a circuit-breaker arrangement comprising a single electrical coil only which is combined with an opening spring in a compact design suitable for generating a high actuating force.

According to an exemplary embodiment disclosed herein, an opening spring of a magnetic actuator unit can have quite a large diameter and be at least partly accommodated inside a groove formed in a disc-shaped armature whose dimension corresponds to the outer shape of the ferromagnetic yoke. This means that for a circular disc-shaped armature the corresponding ferromagnetic yoke can also be circular shaped having approximately the same diameter.

In other words, the opening spring can be hosted in a groove inside the armature of a magnetic actuator unit.

For example, the groove can be formed as an annular clearance having a U-shaped cross-section in order to provide enough space for accommodating the opening spring.

In an exemplary embodiment, the annular grooves mainly or fully accommodate the opening spring means if the magnetic actuator unit is in the second end position. Thus, the opening spring rests mainly opposite to the electrical coil of the magnetic actuator unit in order to reduce the influence of the spring means and the groove on the force-generating ability of the magnetic circuit.

Depending on the specific application, the outer yoke of the magnetic actuator unit which mainly forms the outer dimensions of the magnetic actuator unit can be designed in various ways. For a circular cross-section of the yoke, the middle diameter of the annular groove can, for example, range between the inner and the outer diameters of the electrical coil. For a rectangular crossed section of the yoke, the middle diameter of the annular groove can, for example, lie outside said range between the inner and outer diameters of the electrical coil. In this case the reduction of the static holding force of the magnetic actuator unit can be mostly acceptable.

According to an exemplary embodiment the at least one opening spring includes (e.g., consists of) a cylindrical compression spring of a quite high diameter made of spring wire steel, which is inserted in the annular groove. Alternatively, it is also possible to use several small cylindrical compression springs, which are inserted in the annular groove one to another in order to form a chain of adjacent single compression springs made of spring wire steel. According to another embodiment, the opening spring can rest either directly on the bobbin of the electrical coil that will generally be made of plastic material, or alternatively, on an additional dedicated plate to avoid that the edges of the opening spring can scratch the bobbin of the electrical coil. Therefore, the dedicated plate can be made of, for example, a sheet metal material.

In order to reach a more compact design of the magnetic actuator unit it is recommended to place the ring-shaped permanent magnet axially below the ring-shaped electrical coil, which is surrounded by the ferromagnetic cup-shaped yoke. On this arrangement an inner core element made of ferromagnetic material is surrounded by the permanent magnet.

An exemplary medium-voltage circuit-breaker as shown in FIG. 1 principally includes a pole part 1 with an upper electrical terminal 2 and a lower electrical terminal 3 for electrically connecting a medium-voltage circuit. For the switching function, the lower electrical terminal 3 is connected to an electrical contact which is axially movable between the closed and the opened position via a jackshaft arrangement 4. This jackshaft arrangement 4 internally couples the mechanical energy of a magnetic actuator unit 5 to the pole part 1.

The magnetic actuator unit 5 includes (e.g., consists of) a single electrical coil for switching of an armature 6 to the relative positions effected by magnetic fields.

The pole part 1 can comprise an external insulating sleeve 15 made of synthetic material for electrically insulating the pole part 1 to the environment, The insulating sleeve 15 supports and houses a vacuum interrupter insert 16 having the pair of corresponding electrical contacts as described above. Both electrical contacts can be switchable inside the vacuum interrupter insert 8 under vacuum atmosphere.

Figure 2:
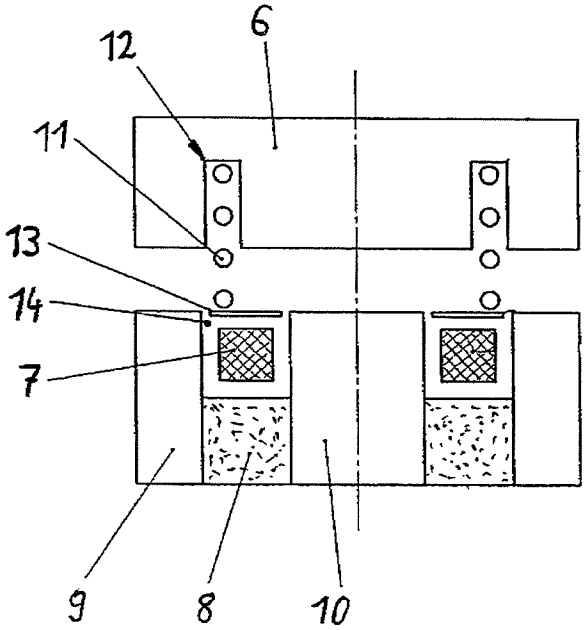
FIG. 2 shows a longitudinal view of an exemplary magnetic actuator unit in a first position.

According to FIG. 2 the magnetic actuator unit is shown in the first end position according to the opened switching position of the connected circuit-breaker.

The magnetic actuator unit uses a single electrical coil 7 for moving the armature 6 to a second position due to electrical current feed. Additionally to the single electrical coil 7 a permanent magnet 8 is provided which loads the armature 6 in the same direction. The single electrical coil 7 as well as the permanent magnet 8 is surrounded by an outer ferromagnetic yoke 9 for directing the magnetic flux to the movable ferromagnetic armature 6.

The ferromagnetic yoke 9 defines the outer geometrical dimensions of the magnetic actuator unit which has a circular cross-section according to the present example. In the axial direction the permanent magnet 8 is arranged below the electrical coil 7 in order to form a compact design. The ferromagnetic arrangement comprising the outer ferromagnetic yoke 9, the ring-shaped permanent magnetic 8 and the inner ferromagnetic core 10 direct the magnetic flux to the axial movable ferromagnetic armature 6.

For permanent loading the armature 6 in the direction of the first position a single cylindrical compression spring 11 is provided. The cylindrical compression spring 11 is made of spring wire steel and mainly accommodated inside a corresponding annular groove 12. The annular groove 12 has a U-shaped cross-section and is formed as a kind of annular clearance. The diameter of the annular groove 12 can range between the inner and outer diameters of the electrical coil 7 as shown. Moreover, the disc-shaped armature 6 is adapted to the outer shape of the ferromagnetic yoke 9. On the front side of the electrical coil 7 the single compression spring 11 rests on a metal dedicated plate 13 covering a bobbin 14 of the electrical coil 7.

Figure 3:
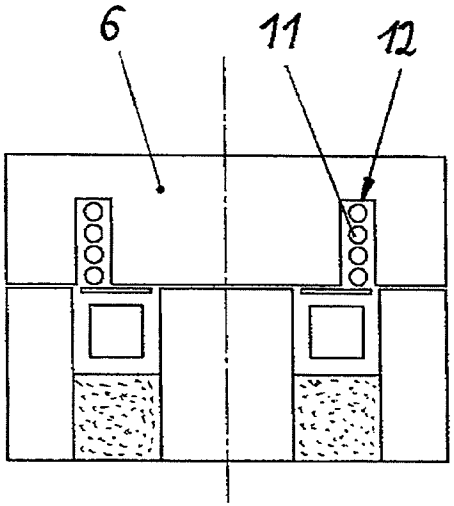
FIG. 3 shows a longitudinal view of an exemplary magnetic actuator unit in a second position.

FIG. 3 shows the magnetic actuator unit in the retracted state according to the second position in which the pole part arrangement is in the closed switching position. In that position the single cylindrical compression spring 11 is fully compressed and fully accommodated inside the annular groove 12.

Figure 4:
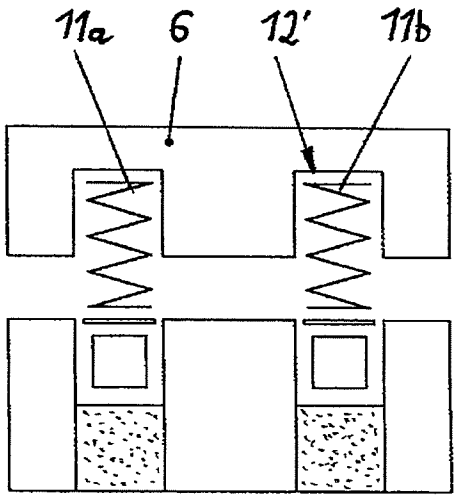
FIG. 4 shows a longitudinal view of an exemplary magnetic actuator unit with different opening spring means.

In the exemplary embodiment according to FIG. 4, instead of a single compression spring several small cylindrical compression springs 11*a*, 11*b* (for example) are provided. These several cylindrical compression springs 11*a*, 11*b* can also be made of spring wire steel inserted in the annular groove 12'. For accommodating the cylindrical compression springs 11*a*, 11*b*, etc. the corresponding annular groove 11' has a larger cross-section than in the first embodiment as described above.

The invention is not limited by the exemplary embodiments as described herein which are presented as an example only but can be modified in various ways within the scope of protection defined by the following patent claims.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

REFERENCE SIGNS

1 Pole part
2 upper electrical terminal
3 lower electrical terminal
4 jackshaft
5 magnetic actuator unit
6 armature
7 electrical coil
8 permanent magnet
9 ferromagnetic yoke
10 ferromagnetic core
11 compression spring
12 annular groove
13 dedicated plate
14 bobbin
15 insulating sleeve
16 vacuum interrupter insert

The invention claimed is:

1. A magnetic actuator unit for a circuit-breaker arrangement, comprising:

an unperforated disk-shaped ferromagnetic armature arranged to be movable along an axis between a first end position and second end position for an opened and closed switching position respectively of a circuit-breaker;

a single electrical coil for moving the armature to the second end position in response to an electrical current feed wherein the coil and the armature are arranged to not overlap in any plane perpendicular to the axis;

a permanent magnet for additionally loading the armature in a direction of a second position;

an outer ferromagnetic yoke at least partly surrounding the single electrical coil and a ferromagnetic core for directing magnetic flux to the armature; and an opening spring for loading the armature in the direction of the first position, which is coaxially arranged between said armature and a front side of the electrical coil, wherein in an open switching position, the opening spring is partly accommodated inside a groove formed in the armature and partly accommodated outside the groove, the outer dimension of the armature corresponding to an outer dimension of the ferromagnetic yoke.

2. Magnetic actuator unit according to claim 1, wherein the groove is formed as an annular clearance with a U-shaped cross-section.

3. Magnetic actuator unit according to claim 2, wherein the groove is annular, and mainly accommodates the opening spring to reduce an influence of the spring means and the groove on the force-generating ability.

4. Magnetic actuator unit according to claim 1, wherein for a circular cross-section of the yoke, a middle diameter of the groove ranges between inner and outer diameters of the electrical coil.

5. Magnetic actuator unit according to claim 1, wherein for a rectangular cross-section of the yoke, a middle diameter of the groove lies outside a range between inner and outer diameters of the electrical coil.

6. Magnetic actuator unit according to claim 1, wherein the opening spring is a single cylindrical compression spring made of spring wire steel inserted in the groove.

7. Magnetic actuator unit according to claim 1, wherein the opening spring is several adjacent cylindrical compression springs made of spring wire steel inserted in the groove.

8. Magnetic actuator unit according to claim 6, wherein the at least one compression spring rests at least partly directly on a bobbin of the electrical coil.

9. Magnetic actuator unit according to claim 6, wherein the at least one compression spring rests at least partly directly on a dedicated plate covering a bobbin of the electrical coil.

10. Magnetic actuator unit according to claim 1, wherein the permanent magnet is ring-shaped and arranged axially below the electrical coil which is ring-shaped and surrounded by the ferromagnetic yoke.

11. A medium voltage circuit-breaker comprising:

a magnetic actuator unit for the circuit-breaker including:

an unperforated disk-shaped ferromagnetic armature arranged to be movable along an axis between a first end position and second end position for an opened and closed switching position respectively of a circuit-breaker;

a single electrical coil for moving the armature to the second end position in response to an electrical current feed wherein the coil and the armature are arranged to not overlap in any plane perpendicular to the axis;

a permanent magnet for additionally loading the armature in a direction of a second position;

an outer ferromagnetic yoke at least partly surrounding the single electrical coil and a ferromagnetic core for directing magnetic flux to the armature;

an opening spring for loading the armature in the direction of the first position, which is coaxially arranged between said armature and a front side of the electrical coil, wherein in an open switching position, the opening spring is partly accommodated inside a groove formed in the armature and partly accommodated outside the groove, the dimension of the armature corresponding to an outer dimension of the ferromagnetic yoke;

at least one pole part with an integrated pair of corresponding electrical contacts, wherein one of the electrical contacts of each pole part is axially movable inside the pole part in order to form an electrical switch; and a jackshaft arrangement for operating the electrical switch by the armature of the magnetic actuator.

12. Medium voltage circuit-breaker according to claim 11, wherein three pole parts are provided forming a 3-phase power grid circuit-breaker.

13. Magnetic actuator unit according to claim 7, wherein the compression springs rest at least partly directly on a bobbin of the electrical coil.

14. Magnetic actuator unit according to claim 7, wherein the compression springs rest at least partly directly on a dedicated plate covering a bobbin of the electrical coil.

15. Magnetic actuator unit of claim 1, in combination with a circuit breaker that is operable by the magnetic actuator switch.

* * * * *